US005825138A

United States Patent [19]

Diazzi et al.

[11] Patent Number: 5,825,138

[45] Date of Patent: Oct. 20, 1998

[54] TIMING OF DIFFERENT PHASES IN AN IGNITION CIRCUIT

[75] Inventors: Claudio Diazzi, Sesto Calende; Mario Tarantola, Bareggio; Fabrizio Martignoni, Morazzone, all of Italy

[73] Assignee: SGS-Thomson Microelectronics, S.r.l., Milan, Italy

[21] Appl. No.: 721,437

[22] Filed: Sep. 27, 1996

[30] Foreign Application Priority Data

Sep. 27, 1995 [IT] Italy ..... 95830396.8

[51] Int. Cl.[6] ..... G05F 1/00

[52] U.S. Cl. ..... 315/294; 315/360; 315/362; 315/209 R

[58] Field of Search ..... 315/291–294, 315/194, 199, 360, 362, 209 R, DIG. 4

[56] References Cited

U.S. PATENT DOCUMENTS 4,087,702 5/1978 Kirby et al. ..... 315/194 X
4,095,139 6/1978 Symonds et al. ..... 315/153
4,241,295 12/1980 Williams, Jr. ..... 315/294
5,049,790 9/1991 Herfurth et al. ..... 315/291

FOREIGN PATENT DOCUMENTS

0338109 A1 4/1988 European Pat. Off. .
0359860 A1 9/1988 European Pat. Off. .

*Primary Examiner*—Robert J. Pascal
*Assistant Examiner*—Haissa Philogene
*Attorney, Agent, or Firm*—Allen, Dyer, Doppelt, Milbrath & Gilchrist, P.A.

[57] ABSTRACT

The need of implementing a second local oscillator in addition to the drive oscillator, for timing the different phases of the starting process of a half-bridge or bridge stage driving an external load, such as a fluorescent lamp, is avoided by employing a timing counter to count the number of oscillations produced by the drive oscillator, and a digital-to-analog converter for controlling the frequency of oscillation of the drive oscillator.

18 Claims, 6 Drawing Sheets

OR

OR

TIMING OF DIFFERENT PHASES IN AN IGNITION CIRCUIT

CROSS-REFERENCE TO RELATED APPLICATION

This application claims priority from 95830396.8, filed Sep. 27, 1995, which is hereby incorporated by reference. However, the content of the present application is not necessarily identical to that of the priority application.

BACKGROUND AND SUMMARY OF THE INVENTION

The present invention refers to a driving circuit of a bridge or half-bridge stage that comprises means for timing the different operating phases. More in particular, this invention refers to a timing device for the preconditioning (preheating) phases of the bridge or half-bridge load. The invention is particularly useful for driving fluorescent lamps.

Usually, the optimal ignition procedure of a fluorescent lamp requires the preheating of filaments for a period of time that may vary between hundreds of milliseconds to a few seconds. The driving of the lamp occurs by exploiting an appropriate resonant LC circuit as schematically shown in the diagram of FIG. 1. The frequency of oscillation imposed by the driving circuit during the preheating phase is higher than the resonant frequency of the LC circuit (that is of the load of the bridge). Once the preheating phase is completed, the driving frequency of the bridge or half-bridge stage is diminished. This increases the voltage on the capacitor C to the point where the lamp terminals reach the arcing voltage, thus igniting the lamp.

The preheating time may be preestablished in various ways.

In the specific case of resonant loads as in the illustrated case of a fluorescent lamp, analog devices may be employed, for example of the PTC type (Positive Temperature Coefficient), or otherwise it is possible to exploit the charge and discharge of external capacitors that may be connected to a pin of the device which will not interfere with the oscillating frequency of the driving circuit of the power bridge stage.

FIG. 2 shows the example of a resonant load circuit of a fluorescent lamp provided with a PTC device. Initially, the current flows through the PTC device, heating the lamp electrodes by Joule effect, thus stimulating thermoionic emission. As the current increases, the resistance of the PTC device increases and the bridge's load gradually becomes more similar to an LC circuit, whose impedance tends to rapidly decrease, thus increasing the voltage on the lamp until it eventually ignites. The timing of the preheating phase using a PTC device is not very precise since it strongly depends on the ambient temperature at which the system is operating (for example, it may depend on when and for how long the lamp was previously turned on and on the heat dissipation characteristics of the system).

When a higher timing precision is required for the preheat ignition sequence, the usual solution (as shown in FIG. 3) is that of employing a timing counter (Timer) capable of counting the oscillations of an auto-oscillating circuit (Oscillator) and of producing an output signal that modifies the oscillating frequency of the local oscillator of the driving circuit. The adjustment of the duration of the preheating period is obtained by modifying the value of an external capacitor (CT) that regulates the oscillation frequency of a second oscillator, dedicated to this auxiliary timing function.

This produces shifts in oscillator frequency Fosc, during Preheat, Ignition, and Running phases, as shown in FIGS. 3*a* and 3*b*. This alternative way to regulate preheating time is more precise than that of the system shown in FIG. 2 because it does not directly depend on the temperature. However, it involves the integration of a second oscillator as well as requiring a dedicated pin (typically provided with a relative protection from electrostatic discharges (ESD)) specifically for this function, in addition to a further external capacitor CT.

Similar requirements may also occur when driving resonant loads different from a fluorescent lamp, and for this reason, the above discussed problem and the relative solution that is the object of the present invention must be considered in more general terms and not be limited to the specific instance of a load constituted by a fluorescent lamp.

The circuit arrangement of the present invention allows for controlling the duration of the different preconditioning or preheating phases, the timing of the start-up or ignition, and of attaining steady state operating conditions of a resonant load of a bridge or half-bridge stage without either the integration of a second oscillating circuit or the use of a pin of the device for connecting an external capacitance for regulating the frequency of oscillation of such a second or auxiliary oscillator.

The system of the invention is based on the use of an n-bit digital counter that can be started up by a command generated by the logic circuitry of the control system and is capable of counting the oscillations generated by the same oscillator of the driving circuit of the bridge or half-bridge stage. The duration of the preheating phases may be preestablished in the design stage or programmable by means of suitable memories (PROM, EPROM or EEPROM) or similar devices.

According to an important aspect of the circuit of the invention, the n outputs of the timing digital counter drive a digital-to-analog converter DAC, whose output current is used for regulating a current controlled oscillator (CCO) of the driving circuit.

By increasing the number of bits of the timing counter and the corresponding number of current generators of the digital-to-analog converter, it is possible to increase the number of steps through which the adjustment of the driving circuit oscillation frequency takes place, thus preventing excessively large and abrupt variations of the frequency of oscillation.

By program modification of an appropriate decoding circuit, it is then possible to define the different duration intervals corresponding to the different start-up phases, for example, the preheating time, the time of the decrement of the oscillation frequency (until the arc starts), and the time of incrementing the frequency until reaching an appropriate value for steady state operation.

Of course, programming can be defined by the fabrication masks or carried out by electric means on the finished device.

BRIEF DESCRIPTION OF THE DRAWING

The disclosed inventions will be described with reference to the accompanying drawings, which show important sample embodiments of the invention and which are incorporated in the specification hereof by reference, wherein.

The various aspects and relative advantages of this invention will become even more evident through the following description of some important embodiments and by referring to the enclosed drawings, wherein.

DETAILED DESCRIPTION OF THE PREFERRED EMBODIMENTS

Figure 1:
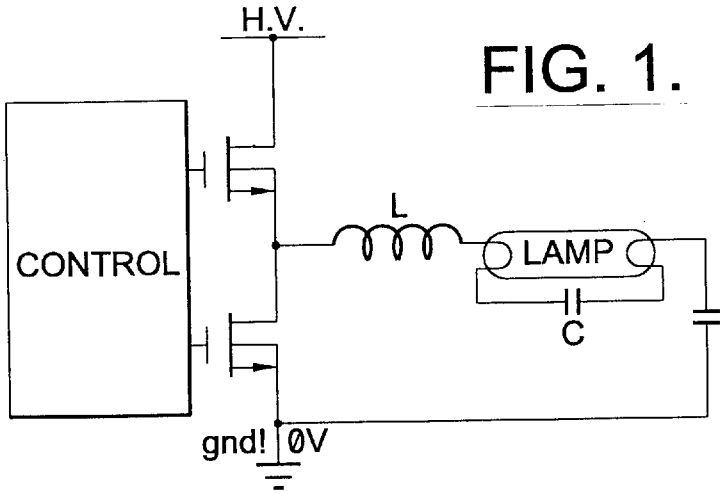
FIG. 1 shows, as previously mentioned, a typical driving scheme for a fluorescent lamp.
Figure 2:
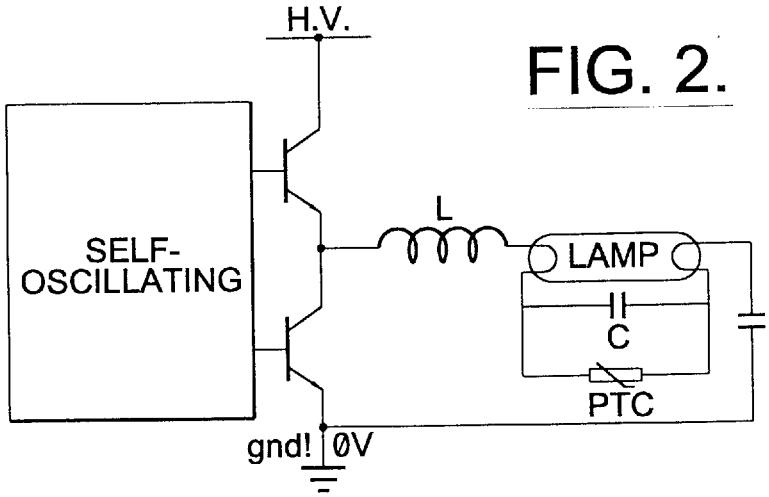
FIG. 2 shows, as previously mentioned, the driving scheme of a fluorescent lamp that comprises an analog device for regulating the preheating time.
Figure 3:
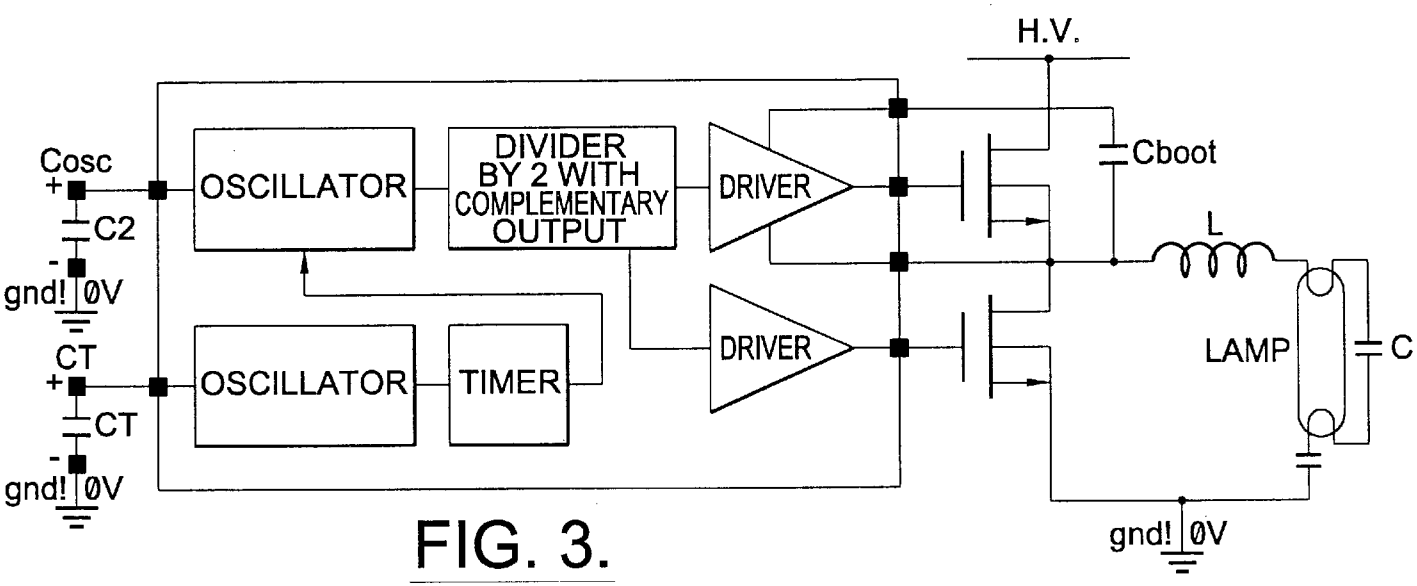
FIGS. 3, 3*a* and 3*b* schematically show, as previously mentioned, a block diagram of a driving circuit employing a second oscillator and a timing counter for controlling the preheating time and the relative operation diagrams of the circuit.
Figure 3B:
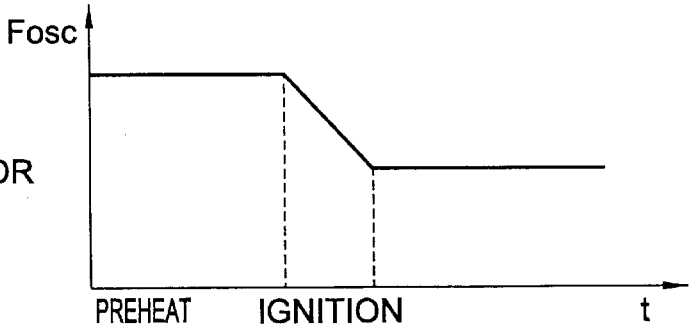
Figure 3A:
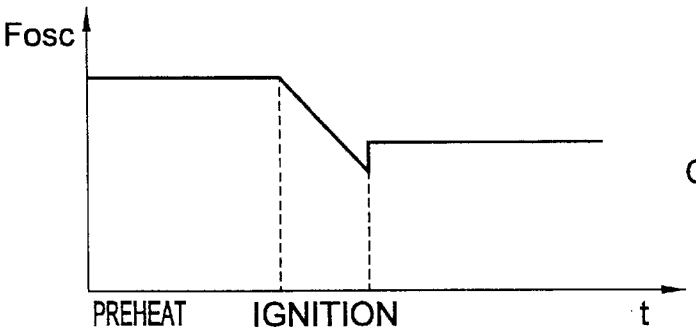
Figure 4:
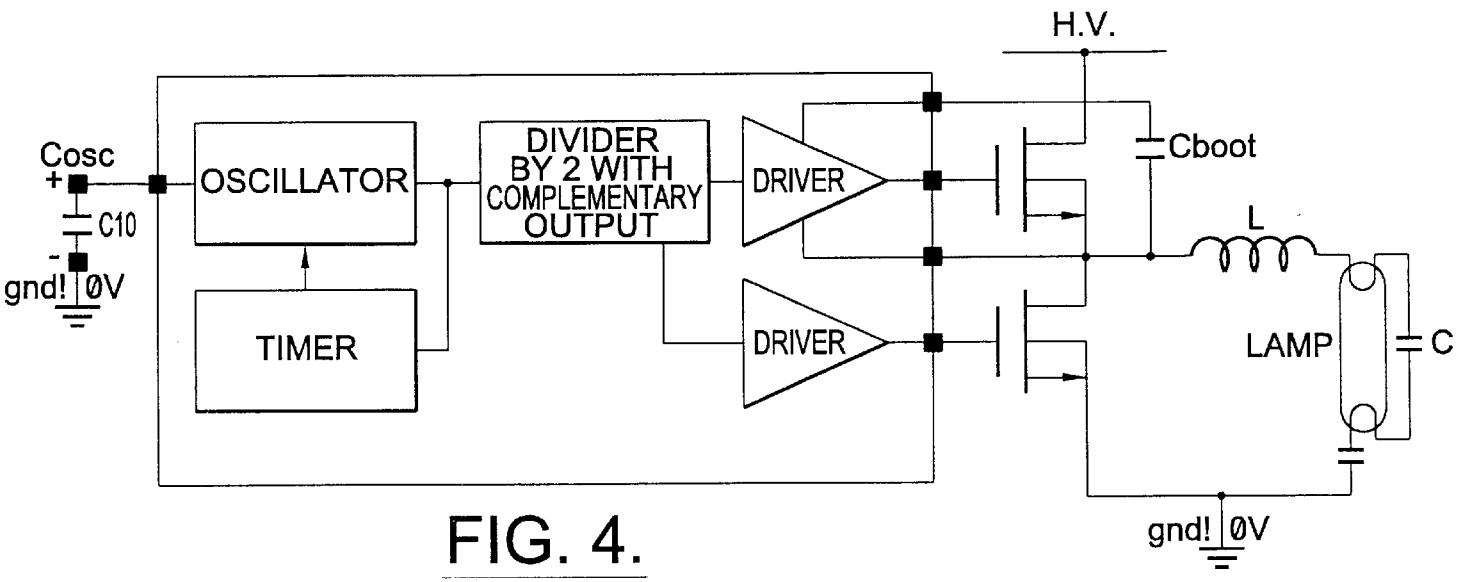
FIGS. 4, 4*a* and 4*b*, schematically show a block diagram of a circuit realized according to the present invention and the relative operation diagrams.
Figure 4B:
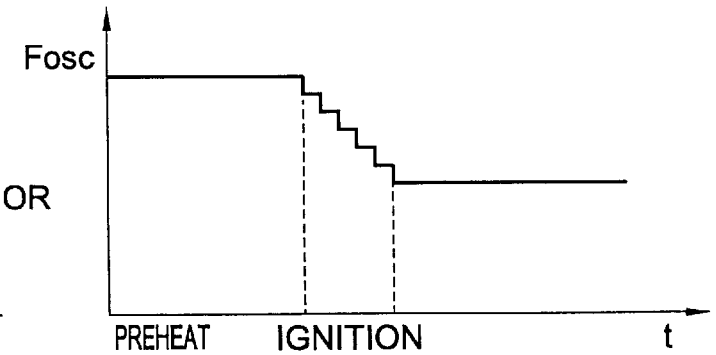
Figure 4A:
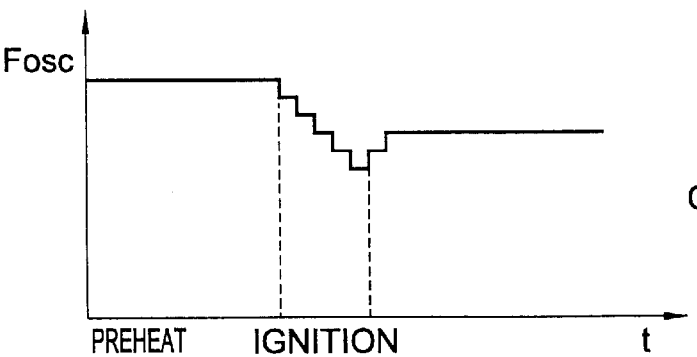

The numerous innovative teachings of the present application will be described with particular reference to the presently preferred embodiment (by way of example and not of limitation), in which:

The system of the invention, in the presently preferred embodiment, is diagrammatically shown in FIGS. 4, 4*a* and 4*b*. As may be observed, the diminishing of the oscillation frequency of the oscillator of the driving circuit, after a certain preheating time and the successive eventual increasing of the frequency toward a steady state value, is realized by a timing counter (Timer) that counts the number of oscillations produced by the same local oscillator (Oscillator) of the driving circuit, without the need of a second oscillator which would be dedicated to the timing functions.

As shown in the diagrams of FIGS. 4*a* and 4*b*, illustrating the operating characteristics, the digital output of the timer can be advantageously used for gradually changing the frequency from the initial oscillation frequency that is maintained for a certain preheat period toward a typically lower working frequency.

By using a standard digital-to-analog converter (DAC) circuit, a signal can be generated whose level is incremented by a constant amount as the counting of the number of oscillations by the counter proceeds.

Figure 5:
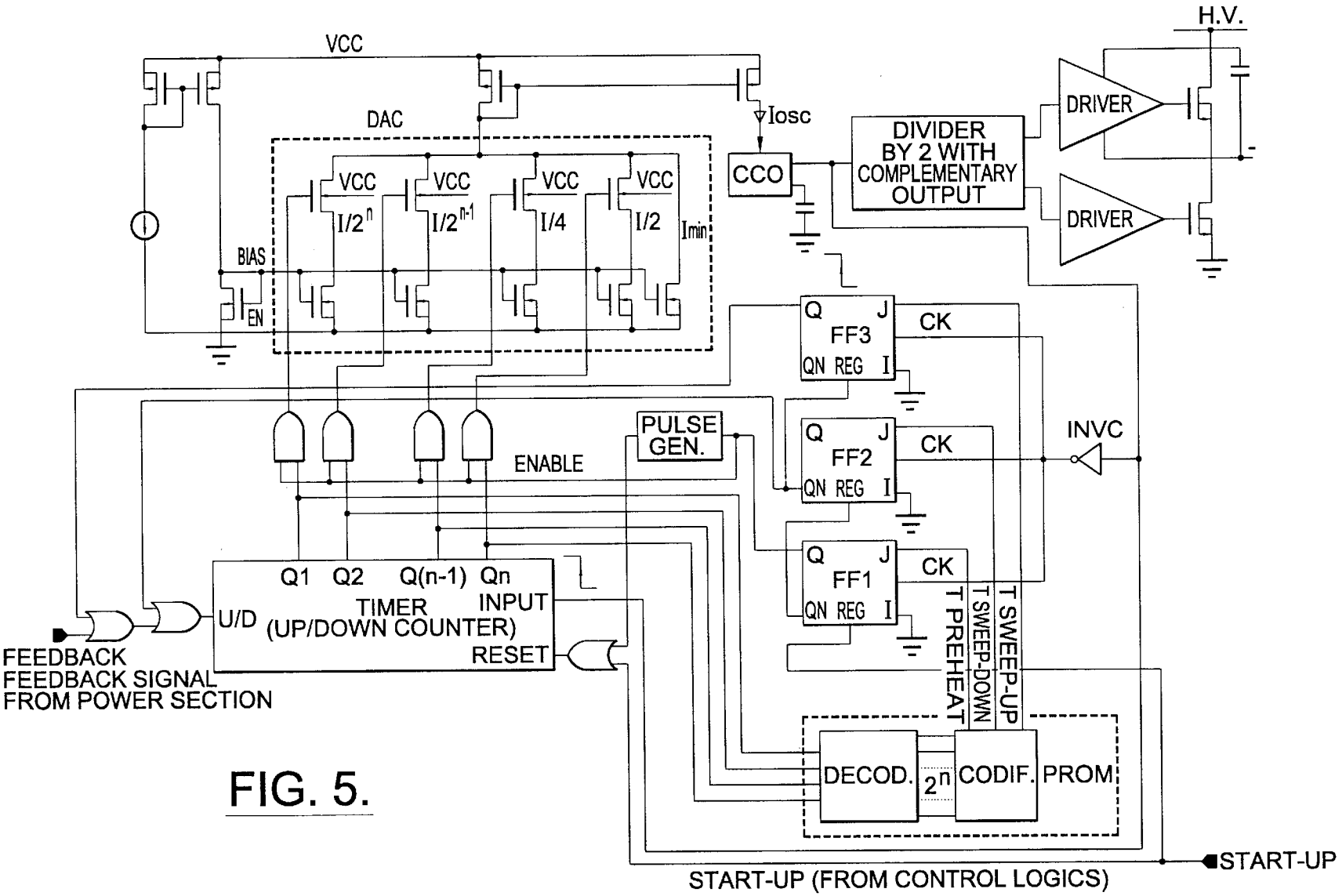
FIG. 5 is a more detailed diagram of an embodiment of the invention.

According to a preferred embodiment of the invention, the circuit can be realized according to a functional scheme as shown in FIG. 5. The timing counter (Timer) is reset by a start-up signal generated by the logic circuit of the control system.

A dedicated coding-decoding circuit CODIF/DECOD, that may be prearranged in the design stage or programmable (according to methods already mentioned above) defines the time intervals of interest (Tpreheat, Tsweep-down, Tsweep-up). This block, indicated with PROM as a whole, can be realized in various functionally equivalent ways (as will be obvious to one of ordinary skill in the art). The CODIF block can be implemented as a set of programmable connections, whereas the DECOD blocks may be viewed as a set of NAND gates.

The output signals (Tpreheat, Tsweep-down, Tsweep-up) can be stored by bistable circuits (Flip-Flops) which attend to the functioning of the timer and enable the DAC through a series of AND gates (A1, A2, . . . ).

The n outputs of the counter (Q1, Q2, . . . , Qn) drive a digital-to-analog converter circuit (DAC) which is constituted by the MOS transistor M0, M1, . . . Mn, M30, M31, M(30+n) and has a current output. The maximum output current value of the losc converter, which constitutes the control signal of the current controlled oscillator (CCO), is given by the following equation:

$$I\max = I\min + I\frac{2^n - 1}{2^n},$$

when the counter outputs Q1, Q2, Qn are all low (i.e. to a logic value "0").

The minimum Iosc value corresponds to the Imin current produced by the first generator MO in a configuration where all the counter outputs interfacing with the DAC assume a high logic value ("1").

It is important to highlight the fact that the number n of timer outputs and the number of the DAC inputs are totally independent, and as such, may advantageously be different from each other. It is only for simplicity of description that these were shown equal (equal to n). As in the example shown, the timer may be realized with an Up-Down Counter which can be reset by the start-up signal.

From the moment the CCO oscillator starts to oscillate to the moment when the Tpreheat signal assumes a logic state "1", thus causing the switching of the output of the Flip-Flop FF1, the Iosc current remains constant and given by the Imax value. Therefore, the frequency of oscillation remains constant.

This phase defines the preheating or preconditioning time of the lamp (or of an equivalent load).

Depending from the programming of the decoding circuit (DECOD.), the digital-to-analog converter DAC is enabled through the logic gates A1, A2, . . . , An when Tpreheat switches to a high logic state. The same Tpreheat signal, suitably stored, resets the counter to zero (Reset phase).

From this instant onward, the oscillating frequency decreases each time the output digital datum of the timer varies.

Figure 6:
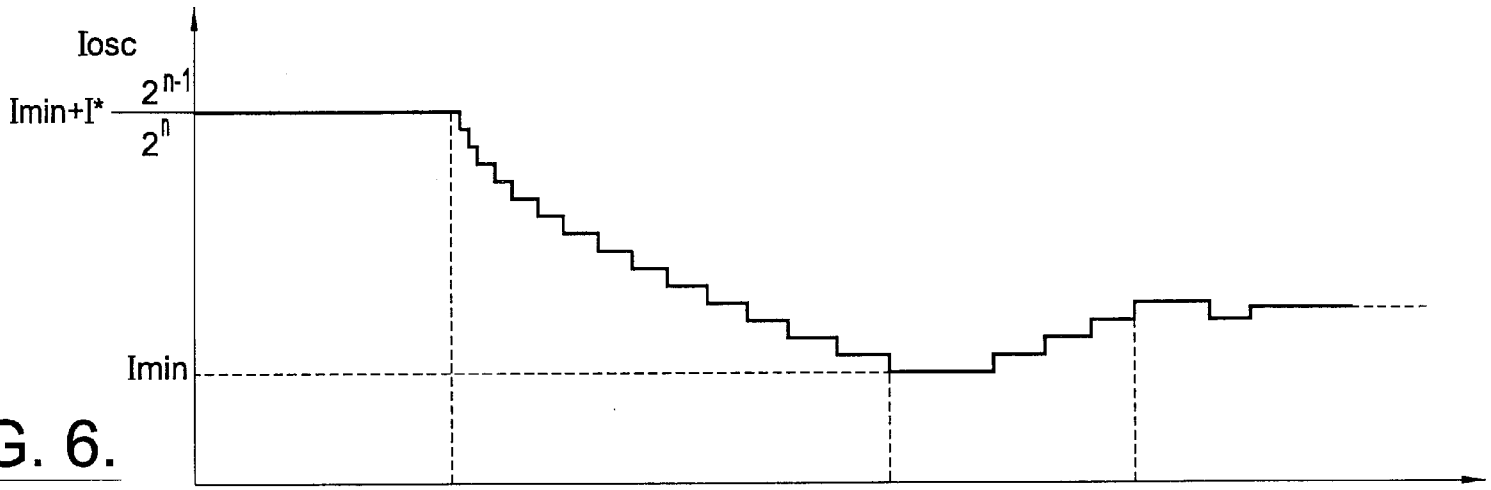
FIGS. 6 and 7 represent the operation diagrams of the circuit of FIG. 5.
Figure 7:
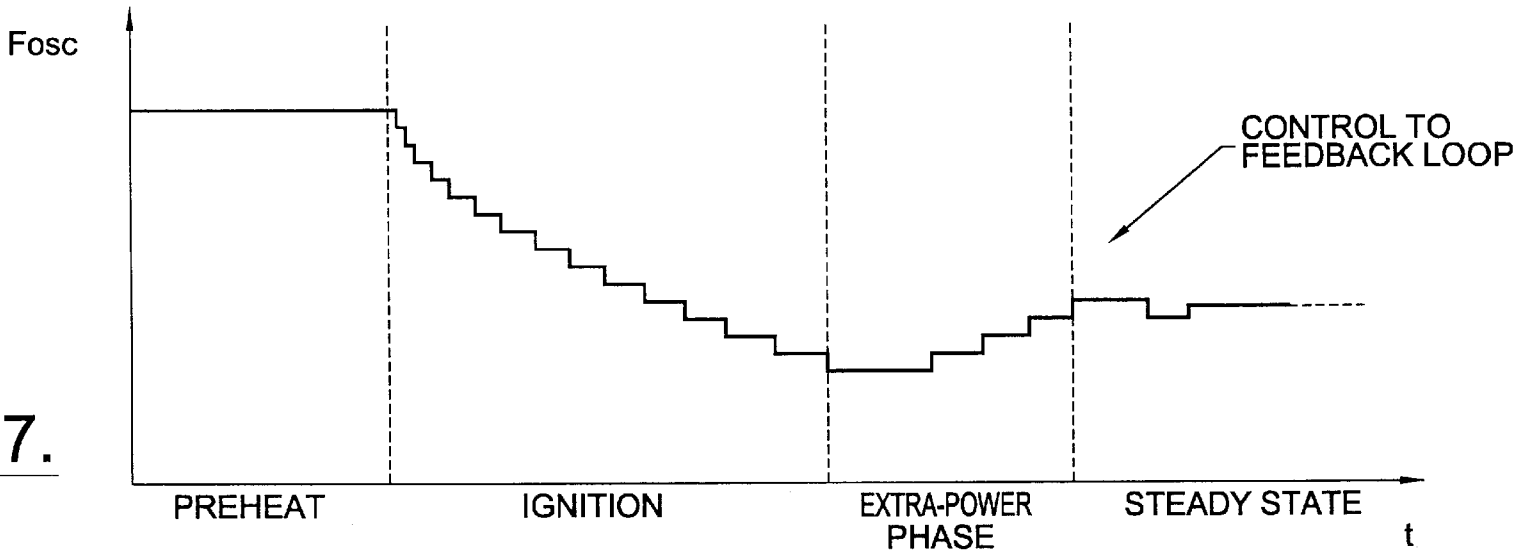

The duration of the time intervals during which the CCO oscillator oscillates at a constant frequency becomes dependent on the oscillating frequency itself (in other words, it increases as the frequency decreases). This is highlighted in the operating characteristics shown in FIGS. 6 and 7 by the nonuniform duration of the steps.

This second phase of operation terminates when the Tsweep-down signal becomes high.

At this point, the aforementioned signal, suitably stored by a bistable circuit FF2, commands a charge of the mode of operation of the Counter; namely from an Up-Counter mode to a Down-Counter mode.

In practice, the DAC retraces backward its previous excursion. This means that the oscillator current starts to increase again, and with it, the frequency of oscillation of the system, always in a stepwise fashion.

The latter phase terminates when the Tsweep-Up signal switches, and with it, the relative bistable circuit FF3. Generally, at this point, the control may commonly be assumed by another signal capable of regulating the functioning of the system under normal steady state condition. Such a steady state control signal is highlighted in the figures with the generic name of Feedback Signal.

In theory, the Tsweep-Up signal and the third bistable circuit FF3 would not be strictly necessary because the Feedback Signal could be enabled by means of the FF2 Flip-Flop output, leaving to the system itself the decision about which control mode to follow (that is the one imposed by the Sweep-Up Signal or that governed by the Feedback Signal).

Figure 8:
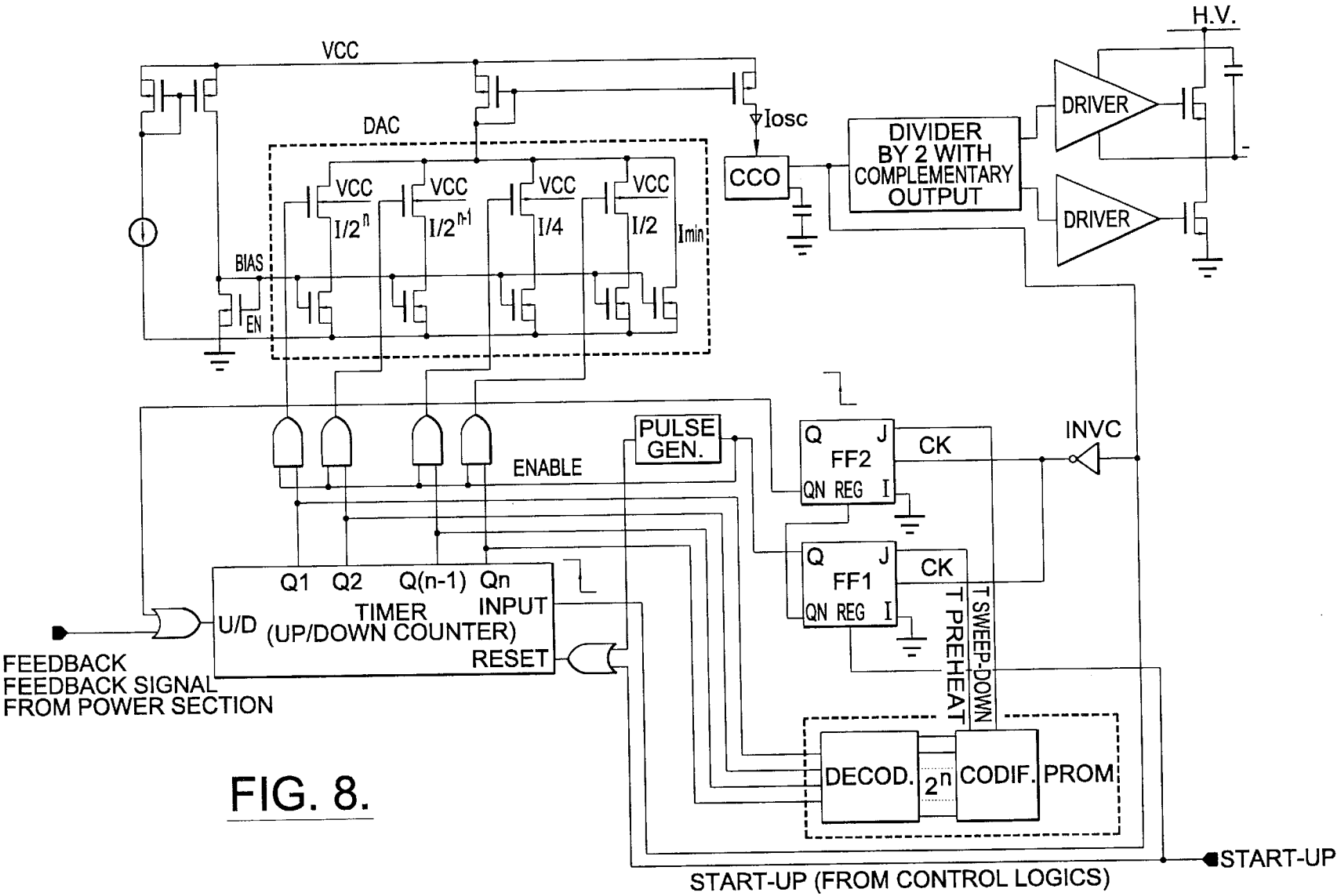
FIG. 8 shows an alternative embodiment of the circuit.

According to this alternative embodiment shown in FIG. 8, the system follows the curve of frequency increment up to the point of attaining the level determined by the Feedback Signal. At this point, the circuit releases itself from the Sweep-Up control and continues functioning under control of the Feedback Signal, which regulates the frequency of oscillation by acting upon the Up/Down Counter and consequently on the DAC, incrementing or decrementing the frequency of oscillation depending on the external conditions.

In the embodiments of FIGS. 5 and 8, the use of Flip-Flops of the JK type is shown employing an inverted clock signal that is in phase opposition to the clock signal of the timer, as provided by an appropriate inverter INVC. This technique has the advantage of avoiding the effects caused by spurious switching (glitch) of the timer by ensuring that the bistable circuit switches when the input signal is stabilized. Naturally, this aspect is not strictly necessary to the functioning of the circuit of the invention because the bistable circuits (Flip-Flop) can also be of a different kind, not requiring an inverted clock signal.

According to one disclosed class of innovative embodiments, there is provided a lamp-driving circuit, for driving a gas-discharge lamp, comprising: a local oscillator operatively connected to drive said lamp; a timing counter connected to count the number of oscillations of said local oscillator; a control circuit connected to said counter and said oscillator to programmably control the frequency of said oscillations; a memory connected to said control circuit.

According to another disclosed class of innovative embodiments, there is provided a lamp-driving circuit, for driving a gas-discharge lamp, comprising: a local oscillator operatively connected to said lamp; a timing counter connected to count the number of oscillations of said local oscillator; a control circuit connected to said counter and said oscillator to programmably control the frequency of said oscillations; a memory connected to said control circuit, said memory having a coding circuit capable of generating at least a first and a second timing signal and a decoding circuit operatively connected to receive an output of said counter; first and second bistable circuits, functionally connected to receive said first and second timing signals and an output of said oscillator, selectively control the output of said counter, selectively load said counter with a predetermined value, and force said oscillator to operate at a set frequency.

According to another disclosed class of innovative embodiments, there is provided a method for driving a gas-discharge lamp, comprising the steps of: driving a gas-discharge lamp with a local oscillator; counting the number of oscillations produced by said oscillator; controlling the frequency of said oscillator according to multiple drive phases with an digital-to-analog converter; wherein said converter is connected to be controlled according to the output of said counter and the contents of a memory.

According to another disclosed class of innovative embodiments, there is provided a circuit for driving a half-bridge or bridge stage at a certain frequency comprising a local oscillator and means capable of modifying for intervals of time of a programmable duration the frequency of oscillation during distinct phases of preconditioning, ignition and steady state operation, referred to a load driven by the stage, characterized in that said means comprise a timing counter capable of counting the number of oscillations produced by said local oscillator and a digital-to-analog converter capable of generating a control signal of the frequency of oscillation of the local oscillator, wherein said memory comprises a coding circuit capable of generating at least a first and a second timing signal and a decoding circuit capable of receiving as input the digital datum represented by the configuration of the n-outputs of said counter; at least a first and a second bistable circuit, both employing as a clock signal, a signal at the controlled frequency of said local oscillator and capable of receiving as input said first and said second timing logic signals, respectively; said bistable circuits being respectively capable of preloading said counter with a programmed value and to enable said n-outputs of the counter to drive the respective stages of said digital-to-analog converter and of transferring the control of said counter to a steady state control signal.

Modifications and Variations

As will be recognized by those skilled in the art, the innovative concepts described in the present application can be modified and varied over a tremendous range of applications, and accordingly, the scope of patented subject matter is not limited by any of the specific exemplary teachings given.

For example, as will be obvious to those of ordinary skill in the art, other circuit elements can be added to, or substituted into, the specific circuit topologies shown.

For another example, within the constraints well-known to those of ordinary skill, power MOS transistors can be replaced by IGBT and/or MCT devices, with appropriate allowance for reduced turn-off times. In some applications power bipolar devices can also be used.

For another example, the circuit shown is not strictly limited to driving conventional fluorescent lamps, but can be used for other kinds of gas-discharge lamps.

For another example, the circuit shown is not strictly limited to driving gas-discharge lamps, but can be used for driving other kinds of negative-impedance devices.

What is claimed is:

1. A lamp-driving circuit, for driving a gas-discharge lamp, comprising:

an oscillator operatively connected to drive said lamp;

a timing counter connected to count the number of oscillations of said oscillator;

a control circuit connected to said counter and said oscillator to programmably control the frequency of said oscillations;

memory connected to said control circuit, including means for generating at least first and second timing signals, and including bistable circuit means connected to said memory and said counter for receiving first and second timing signals and an output of said oscillator and forcing said oscillator to operate at a set frequency.

2. The lamp-driving circuit of claim 1, wherein said control circuit comprises a digital-to-analog converter connected to control said frequency according to the state of said counter and the contents of said memory.

3. The lamp-driving circuit of claim 1, wherein said timing counter is an n-bit Up-Down counter.

4. The lamp-driving circuit of claim 1, wherein said oscillator is a current-controlled oscillator, and said control circuit produces a controlled output current.

5. The lamp-driving circuit of claim 1, further comprising a bridge output stage.

6. The lamp-driving circuit of claim 1, wherein said control circuit controls said frequency according during distinct phases of preconditioning, ignition and steady state operation.

7. A lamp-driving circuit, for driving a gas-discharge lamp, comprising:

a local oscillator operatively connected to said lamp;

a timing counter connected to count the number of oscillations of said local oscillator;

a control circuit connected to said counter and said oscillator to programmably control the frequency of said oscillations;

a memory connected to said control circuit, said memory having a coding circuit capable of generating at least a first and a second timing signal and a decoding circuit operatively connected to receive an output of said counter;

first and second bistable circuits, functionally connected to receive said first and second timing signals and an output of said oscillator, selectively control the output of said counter, selectively load said counter with a predetermined value, and force said oscillator to operate at a set frequency.

8. The lamp-driving circuit of claim 7, wherein said control circuit comprises a digital-to-analog converter connected to control said frequency according to the state of said counter and the contents of said memory.

9. The lamp-driving circuit of claim 7, wherein said timing counter is an n-bit Up-Down counter.

10. The lamp-driving circuit of claim 7, wherein said oscillator is a current-controlled oscillator, and said control circuit produces a controlled output current.

11. The lamp-driving circuit of claim 7, further comprising a bridge output stage.

12. The lamp-driving circuit of claim 7, wherein said control circuit controls said frequency according during distinct phases of preconditioning, ignition and steady state operation.

13. The lamp-driving circuit of claim 7, wherein said decoding circuit generates a third of timing signal, and further comprising a third bistable circuit controlled by said third timing signal capable of defining a phase of increment of the frequency from a minimum value reached at the end of a starting phase to a steady state value, before said control circuit begins controlling said counter.

14. A method for driving a gas-discharge lamp, comprising the steps of:

driving a gas-discharge lamp with a local oscillator;

counting the number of oscillations produced by said oscillator;

controlling the frequency of said oscillator according to multiple drive phases with a digital-to-analog converter;

wherein said converter is connected to be controlled according to the output of said counter and the contents of a memory, generating first and second timing signals within a coding circuit of the memory, receiving the first and second timing signals and an output of the oscillator within first and second bistable circuits, selectively controlling the output of the counter, selectively loading the counter with a predetermined value, and forcing the oscillator to operate at a set frequency.

15. A circuit for driving a half-bridge or bridge stage at a certain frequency comprising a local oscillator and means capable of modifying for intervals of time of a programmable duration the frequency of oscillation during distinct phases of preconditioning, ignition and steady state operation, referred to a load driven by the stage, said means comprise a timing counter capable of counting the number of oscillations produced by said local oscillator and a digital-to-analog converter capable of generating a control signal of the frequency of oscillation of the local oscillator, wherein said timing counter is an n-bit reversible counter (Up-Down), whose n outputs are enabled to drive a digital-to-analog converter having a current output, which controls a current controlled local oscillator, and including a programmable memory of the read only, nonvolatile type capable of defining, depending on the programming, the duration of said distinct phases of operation, and means for generating first and second timing signals, and including bistable circuit means connected to said programmable memory and said counter for receiving first and second timing signals and an output of said oscillator and forcing said oscillator to operate at a set frequency.

16. The circuit according to claim 15, wherein said means for generating first and second timing signals comprises a coding circuit capable of generating at least a first and a second timing signal and a decoding circuit capable of receiving as input the digital datum represented by the configuration of the n-outputs of said counter and said bistable circuit means comprises:

at least a first and a second bistable circuit, both employing as a clock signal, a signal at the controlled frequency of said local oscillator and capable of receiving as input said first and said second timing logic signals, respectively;

said bistable circuits being respectively capable of preloading said counter with a programmed value and to enable said n-outputs of the counter to drive the respective stages of said digital-to-analog converter and of transferring the control of said counter to a steady state control signal.

17. The circuit according to claim 16, characterized in that said decoding circuit generates a third timing signal, and the circuit comprises a third bistable circuit controlled by said third timing signal capable of defining a phase of increment of the frequency from a minimum value reached at the end of a starting phase to a steady state value, before control is transferred to said control signal.

18. The circuit according to claim 17, characterized in that said bistable circuits are Flip-Flops of the JK type employing an inverted clock signal as referred to the clock signal that is applied to said counter.

* * * * *

UNITED STATES PATENT AND TRADEMARK OFFICE

CERTIFICATE OF CORRECTION

PATENT NO. : 5,825,138
DATED : October 20, 1998
INVENTOR(S) : Diazzi et al.

It is certified that error appears in the above-identified patent and that said Letters Patent is hereby corrected as shown below:

On the title page,
item:

[73] Assignee:

Strike:
SGS-Thomson Microelectronics, S.r.l., Milan, Italy

Insert:
SGS-Thomson Microelectronics S.r.l., Agrate Brianza, Milano, Italy

Signed and Sealed this

Twenty-third Day of March, 1999

*Attest:*

Q. TODD DICKINSON

*Attesting Officer*

*Acting Commissioner of Patents and Trademarks*